US008665173B2

(12) United States Patent
Livingston

(10) Patent No.: US 8,665,173 B2
(45) Date of Patent: Mar. 4, 2014

(54) CONTINUOUS CURRENT ROD ANTENNA

(75) Inventor: Stanley W. Livingston, Fullerton, CA (US)

(73) Assignee: Raytheon Company, Waltham, MA (US)

( * ) Notice: Subject to any disclaimer, the term of this patent is extended or adjusted under 35 U.S.C. 154(b) by 147 days.

(21) Appl. No.: 13/205,533

(22) Filed: Aug. 8, 2011

(65) Prior Publication Data

US 2013/0038504 A1 Feb. 14, 2013

(51) Int. Cl.
*H01Q 1/42* (2006.01)

(52) U.S. Cl.
USPC ..... 343/872

(58) Field of Classification Search
USPC ..... 343/872, 817–819
See application file for complete search history.

(56) References Cited

U.S. PATENT DOCUMENTS

| | | | | | |
|---|---|---|---|---|---|
| 4,031,537 | A | | 6/1977 | Alford | |
| 4,749,997 | A | | 6/1988 | Canonico | |
| 4,937,588 | A | * | 6/1990 | Austin | 343/791 |
| 4,999,639 | A | * | 3/1991 | Frazita et al. | 343/704 |
| 5,339,089 | A | * | 8/1994 | Dienes | 343/700 MS |
| 5,568,161 | A | * | 10/1996 | Fulmer, Sr. | 343/816 |
| 5,589,843 | A | * | 12/1996 | Meredith et al. | 343/820 |
| 5,818,398 | A | * | 10/1998 | Tsuru et al. | 343/895 |
| 5,841,405 | A | | 11/1998 | Lee et al. | |
| 6,043,785 | A | | 3/2000 | Marino | |
| 6,057,804 | A | * | 5/2000 | Kaegebein | 343/792 |
| 6,072,439 | A | * | 6/2000 | Ippolito et al. | 343/797 |
| 6,078,298 | A | * | 6/2000 | Planning et al. | 343/840 |
| 6,839,036 | B1 | | 1/2005 | Apostolos et al. | |
| 7,098,861 | B2 | * | 8/2006 | Theobold et al. | 343/801 |
| 7,315,288 | B2 | | 1/2008 | Livingston et al. | |
| 2005/0219143 | A1 | * | 10/2005 | Schadler et al. | 343/893 |
| 2007/0040758 | A1 | | 2/2007 | Dwyer et al. | |
| 2010/0271267 | A1 | | 10/2010 | Roth et al. | |

FOREIGN PATENT DOCUMENTS

| | | | |
|---|---|---|---|
| EP | 2 073 312 | A1 | 6/2009 |
| JP | 2007-336305 | A | 12/2007 |
| WO | WO 2007/013152 | A1 | 2/2007 |

OTHER PUBLICATIONS

Extended European Search Report for European Application No. 12168440.1, Filed May 17, 2012, Extended European Search Report dated Nov. 6, 2012 and mailed Nov. 13, 2012 (8 pgs.)

* cited by examiner

*Primary Examiner* — Huedung Mancuso
(74) *Attorney, Agent, or Firm* — Christie, Parker & Hale, LLP

(57) ABSTRACT

A Continuous Current Rod Antenna that may be positioned in close proximity to a conductive backplane and has extremely tight lattices which stabilize the radiation impedance and allows dense T/R modules packaging. The Continuous Current Rod Antenna offers lower profile packaging, with higher gain over larger bandwidths than other collinear array techniques.

16 Claims, 19 Drawing Sheets

CONTINUOUS CURRENT ROD ANTENNA

BACKGROUND

1. Field

Aspects of the present invention relate to antenna arrays, and particularly, collinear antenna arrays.

2. Description of Related Art

Collinear antenna arrays have many applications and are often used for aerodynamic applications. An exemplary collinear antenna array includes an array of dipole antennas mounted in such a manner that the corresponding antenna filaments of each antenna are parallel and collinear along a common line or axis. A collinear antenna array may be mounted vertically or horizontally in order to increase overall gain and directivity in the desired direction. However, placing a collinear antenna array in close proximity to its support structures typically results in a tradeoff between bandwidth and/or efficiency. Requirements for antenna arrays to be both compact and wideband generally oppose one another so that optimizing one requirement often negatively affects the other requirements. This is a particular problem for UHF and VHF antenna arrays in which wavelengths range from meters to tens of meters. Some applications such as an airborne platform cannot afford even a meter of added space to house a wideband antenna array on the vehicle or in an external pod. Prior antenna designs have been developed and have failed to meet the desired requirements, which are to be low profile, have a wide bandwidth, and have the ability to support frequency scan as required for a phased array sensor system.

Alford (U.S. Pat. No. 4,031,537) discloses an end fed array of collinear dipoles that can be placed less than a quarter wavelength from a host reflector, but have limited bandwidths. In addition, end fed arrays such as those disclosed in Alford are limiting in beam agility over bandwidth when used with phased arrays.

Canonico (U.S. Pat. No. 4,749,997) discloses a modular antenna array that overcomes the end feed limitation, with parallel fed elements that can be mounted in close proximity to the leading edge of a wing with the aid of collinear dipole elements and Yagi directors. Parasitic directors such as Yagi, or similar directors have the ability to guide energy away from a host, allowing a low profile installation, but Yagi type directors are known to have limited bandwidths.

Marino (U.S. Pat. No. 6,043,785) discloses a slot antenna arrangement that improves upon the limited bandwidth of parallel feed co-linear arrays by proposing flared notches with a balun. Likewise, Lee et al. (U.S. Pat. No. 5,841,405, co-invented by the Applicant and assigned to the same assignee of the instant application) teaches a collinear array of flared bunny ears with improved baluns for wide bandwidth; however both of these designs and similar notch elements often proposed for this type of problem suffer with large size due to their long radiators which are not often suitable for an integrated extreme low profile installation on a host platform.

Other parallel fed collinear antenna arrays such as those disclosed by Kaegebein (U.S. Pat. No. 6,057,804) attempt to solve the above problem with designs capable of tunings over a broad band, but with operating bands relatively small compared to the proposed antenna arrays of the present invention. Apostolos et al. (U.S. Pat. No. 6,839,036) is yet still another attempt to tune a broadband notch element for lower profile operation, but even this design is only of minor improvement.

Still other planar arrays such as an antenna arrays using long slot apertures as disclosed by Livingston et al. (U.S. Pat. No. 7,315,288), which is a "current sheet antenna," have been shown to be both wideband and low profile, but all such examples require a 2-dimensional array of elements with a square footprint of at least ½ wavelength. In many cases these larger footprints would be too large in one dimension to mount on an aircraft wing or inside an aerodynamic pod for the lower UHF and VHF frequencies.

In all prior attempts known to the Applicant to solve the above discussed problems, the lattice spacings are held to be approximately within the range of a quarter to half wavelengths. However, denser packing lattice is still desired.

SUMMARY

Aspects of embodiments according to the present invention are directed toward a novel Continuous Current Rod Antenna that may be fabricated by coupling an array of collinear antenna elements in close proximity to a conductive backplane that is optionally covered with an RF absorber, or meta material. The Continuous Current Rod Antenna has extremely tight lattice which stabilizes the radiation impedance and allows dense T/R modules packaging. A current filament is excited by connecting parallel fed collinear currents and matched by the novel technique using a high dielectric sleeve. The Continuous Current Rod Antenna offers lower profile packaging, with higher gain over larger bandwidths than other collinear array techniques. It is also possible to connect as many transmitter modules as possible to an antenna array for combining power output optically which in turn lowers the output requirement for any one module, as to share the transmit power output between a large number of modules.

According to an embodiment of the present invention, an antenna array includes: a dielectric sleeve extending in a first direction; at least two parallel fed radiator filaments collinearly arranged in the first direction within the dielectric sleeve, the radiator filaments being electrically connected to each other; and a conductive backplane spaced from the radiator filaments by ⅛ wavelength or less of a center operating frequency of the antenna array.

According to an embodiment of the present invention, an antenna array includes: an array of feed lines extending in a first direction; a dielectric sleeve extending in a second direction; at least two radiator filaments configured to be fed in parallel with each other by respective feed lines of the array of feed lines, the radiator filaments collinearly arranged in the second direction within the dielectric sleeve; and a conductive backplane spaced from the radiator filaments by ⅛ wavelength or less of a center operating frequency of the antenna array.

According to an embodiment, a combined length of the radiator filaments in the first direction may be at least about ½ wavelength of the center operating frequency of the antenna array.

According to an embodiment, a cross-section of the dielectric sleeve may have a diameter about 1/100 wavelength of the center operating frequency of the antenna array, and may have a permittivity (Er) of about 40 or greater.

According to an embodiment, wherein the cross-section of the dielectric sleeve may have a round shape or a square shape.

According to an embodiment, the dielectric sleeve may include a low loss high dielectric material such as ceramic magnesium titanate.

According to an embodiment, the antenna array may further include an RF absorber on the conductive backplane. The RF absorber may include a ferrite material having high real permeability and low imaginary permeability.

According to an embodiment, a center-to-center distance between adjacent ones of the radiator filaments may be about 1/20 wavelength or less of the center operating frequency of the antenna array.

According to an embodiment, the antenna array may further include an array of transmission lines respectively connected between the radiator filaments and the backplane.

According to an embodiment, each of the radiator filaments may have a first end and a second end respectively connected to two adjacent transmission lines of the array of transmission lines.

According to an embodiment, the antenna array may further include a plurality of transmit/receive (T/R) modules respectively connected to the radiator filaments via the array of transmission lines. The plurality of T/R modules may be configured to drive the radiator filaments without the use of a balun.

According to an embodiment of the present invention, an antenna system includes: a dielectric sleeve extending in a first direction; a plurality of parallel fed radiator filaments collinearly arranged in the first direction within the dielectric sleeve, the radiator filaments being electrically connected to each other; a conductive backplane spaced from the radiator filaments by 1/8 wavelength or less of a center operating frequency of the antenna array; and a plurality of transmit/receive (T/R) modules respectively electrically connected to the radiator filaments.

BRIEF DESCRIPTION OF THE DRAWINGS

These and/or other aspects of the present invention will become apparent and more readily appreciated from the following description of the embodiments, taken in conjunction with the accompanying drawings of which.

DETAILED DESCRIPTION

Figure 1:
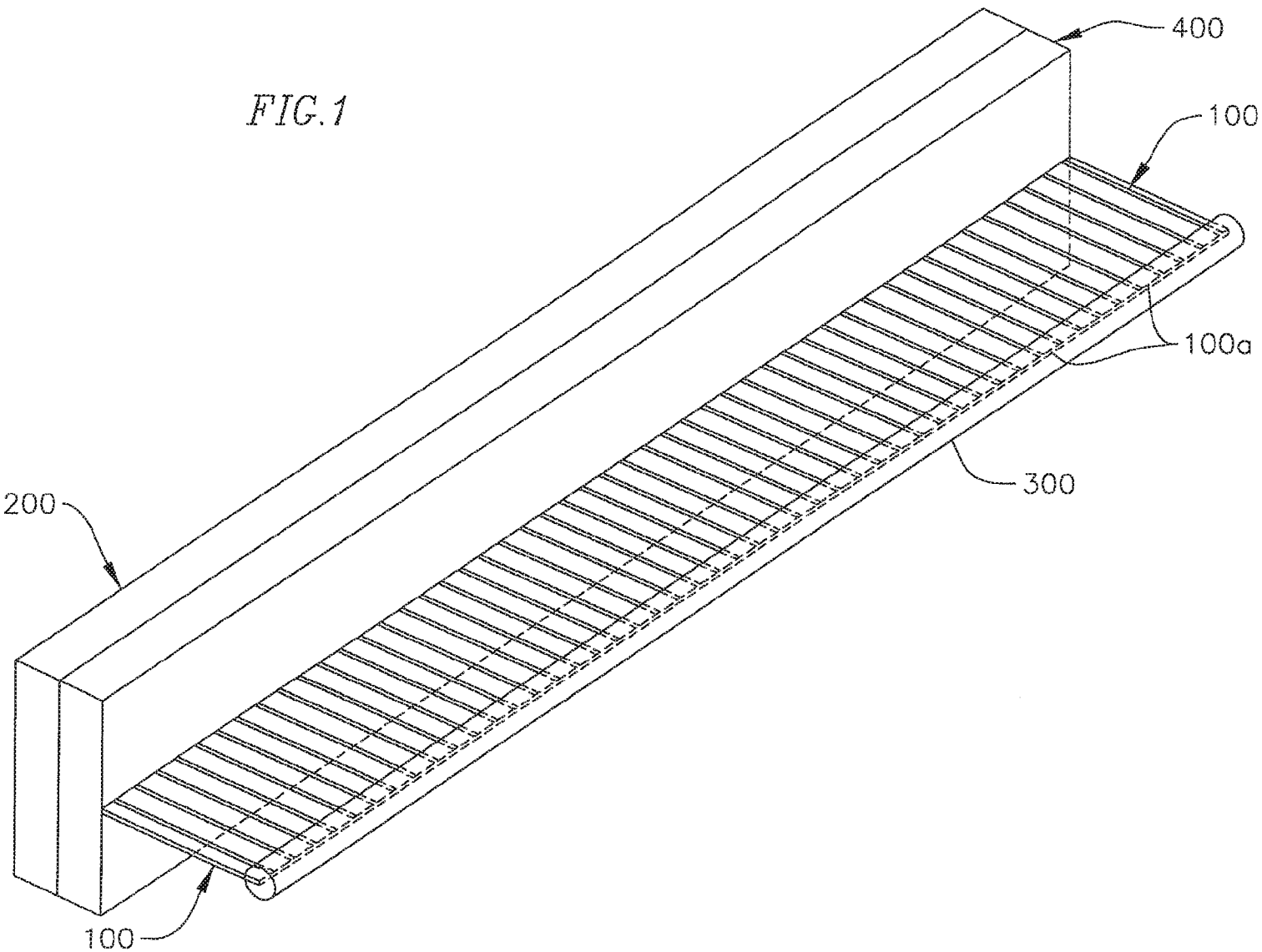
FIG. 1 is a perspective view of a conceptual drawing of a Continuous Current Rod Antenna according to an embodiment of the present invention.

Reference will now be made in detail to embodiments, examples of which are illustrated in the accompanying drawings, wherein like reference numerals refer to the like elements throughout. The present embodiments may have different forms and should not be construed as being limited to the descriptions set forth herein. Accordingly, the embodiments are merely described below, by referring to the figures, to explain aspects of the present invention.

Aspects of the present invention are directed toward wideband and low frequency collinear phased array antennas which may be mounted parallel and in close proximity to host structures such as a building, automobile, and more specifically on an aircraft. Aspects of the present invention are directed toward a Continuous Current Rod Antenna that is described herein as an array of parallel fed electrically connected collinear antenna filaments (or radiator filaments). This novel antenna design provides a compact solution with an order of magnitude greater gain and bandwidth compared to the state of the art. In addition, the volume problems that often plague UHF & VHF broadband antenna systems may be mitigated with an antenna design as shown in FIG. 1 according to an embodiment of the present invention.

FIG. 1 is a perspective view of a conceptual drawing of a Continuous Current Rod Antenna according to an embodiment of the present invention.

Referring to FIG. 1, a plurality of parallel feed lines 100 extend from a conductive backplane 200 (e.g., a metallic backplane) in a first direction. A dielectric sleeve 300 (e.g., a ceramic transverse rod) encloses one end of each of the feed lines 100 and extends in a second direction that is substantially perpendicular to the first direction. The ends of the parallel feed lines 100 form a plurality of radiator filaments 100*a* collinearly arranged in the second direction within the dielectric sleeve 300, and the radiator filaments 100*a* are electrically connected to each other. The conductive backplane 200 may provide support to the parallel feed lines 100 and the dielectric sleeve 300, and may be spaced from the radiator filaments 100*a* or a center of the dielectric sleeve 300 by 1/8 wavelength or less of a center operating frequency of the antenna.

Further, each of the radiator filaments 100*a* may have a length in the second direction equal to substantially less than 1/20 wavelength. The parallel feed lines 100 may be spaced from each other in the second direction by substantially less than 1/20 wavelength. The radiator filaments 100*a* are excited in parallel via the parallel feed lines 100 (e.g., transmission lines). In one embodiment, the parallel feed lines 100 may be transmission lines fabricated on a printed circuit board as striplines or microstrips. In another embodiment, the parallel feed lines 100 may be coaxial cables extending substantially in parallel. According to the above embodiments, the Continuous Current Rod Antenna is mounted in close proximity to a conductive backplane support structure and can radiate over several octaves of bandwidth with high efficiency which has more bandwidth and gain over a wider band than the related art.

Figure 2:
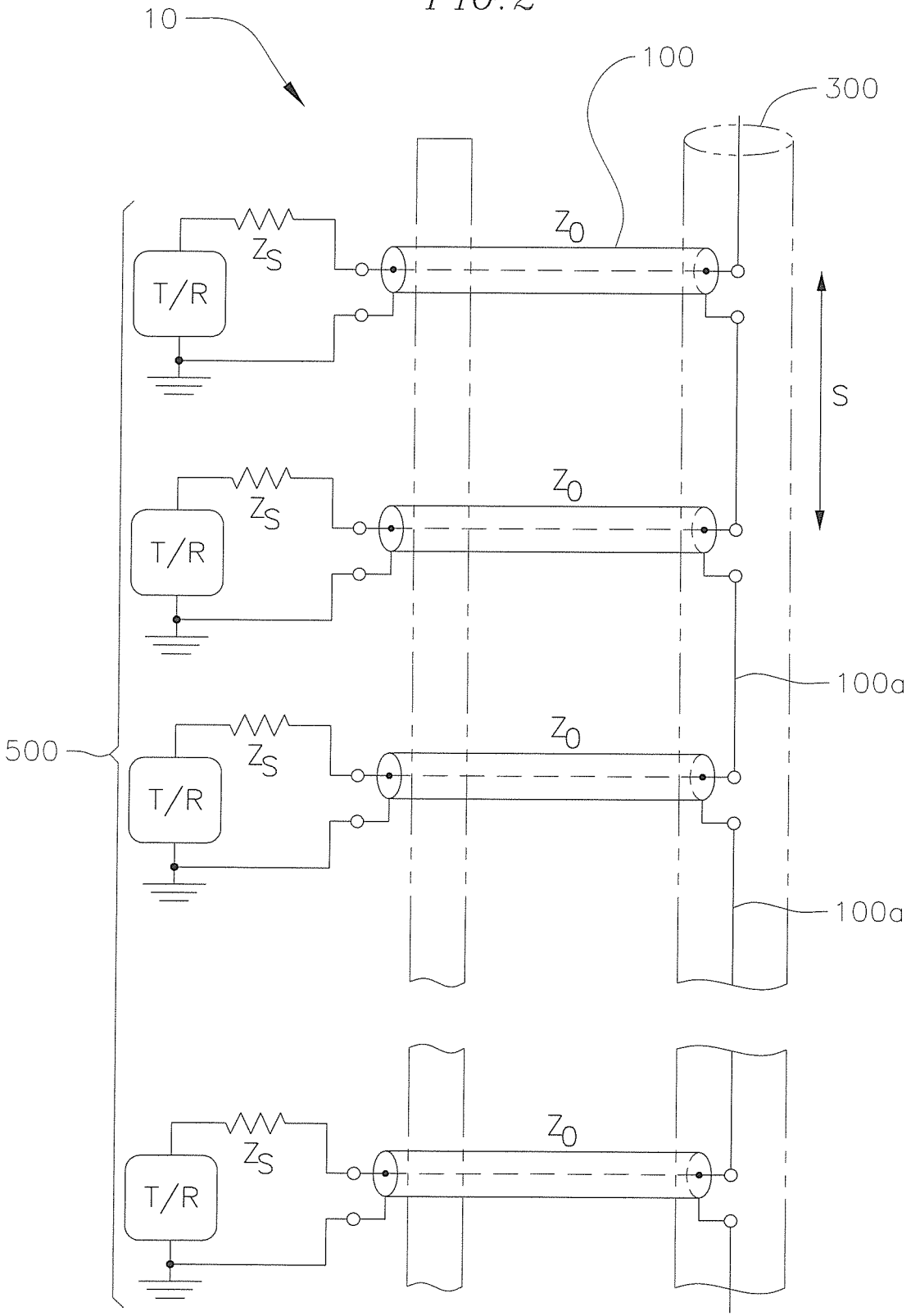
FIG. 2 is a schematic of a phased array system using the Continuous Current Rod Antenna of FIG. 1 according to an embodiment of the present invention.

FIG. 2 is a schematic drawing of a phased array system using the Continuous Current Rod Antenna of FIG. 1 according to an embodiment of the present invention.

Referring to FIG. 2, a phased array system 10 includes the radiator filaments 100*a* respectively connected with an array of active RF transmit/receive T/R modules 500 via the plurality of parallel feed lines 100. The phased array system 10 has source Impedances of Zs, typically but not limited to Zs=50 ohms. The coupling is achieved through directly connecting unbalanced transmission lines (feed lines 100) with matched impedance to source $Z_0$=Zs, and without the use of a balun. Baluns add complexity, volume, power handing limitations, and losses. Therefore, according to an embodiment of the present invention, the radiator filaments 100*a* are directly connected to the unbalanced transmission lines (feed lines 100) connected to the array of RF T/R modules that may be housed inside the backplane 200. As such, the Continuous Current Rod Antenna may be placed in close proximity with a distance D less than ⅛ wavelength of the operating frequency (e.g., a center operating frequency) from the conductive backplane 200.

In the above described embodiment, large bandwidths (e.g., 5:1 frequency ratio or greater) may be achieved. The key in achieving large bandwidths is the very tight lattice spacings that may be employed according to the present embodiment, which in turn allows dense packing of the T/R modules, thereby increasing the power output of the full system from a relatively small volume. Extremely tight lattices that may be achieved according to embodiments of the present invention are on the order of S=1/100 of a wavelength at the lowest frequency and S=1/20 wavelength at the highest frequency of operation. In FIG. 2, S denotes the lattice spacing of the phased array system 10.

Figure 3:
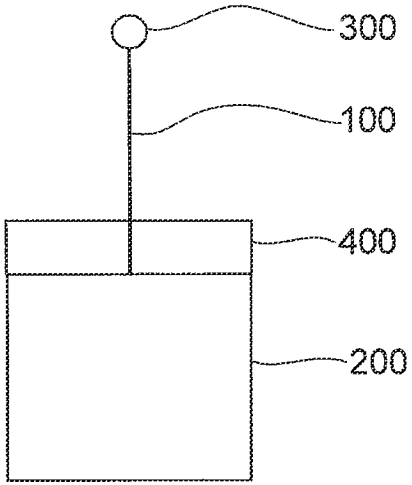
FIG. 3 illustrates a side view of a Continuous Current Rod Antenna and field patterns showing radiation with limited backplane interference at 150 MHz and 500 MHz.
Figure 3:
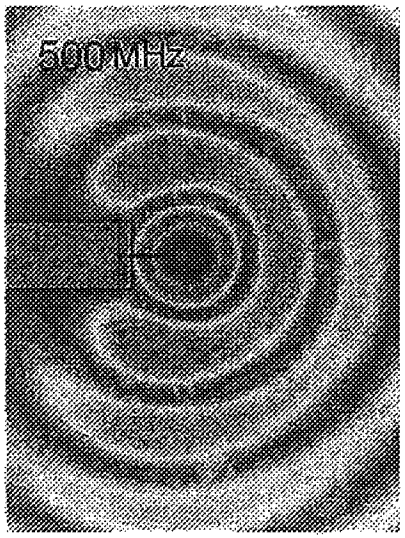
Figure 3:
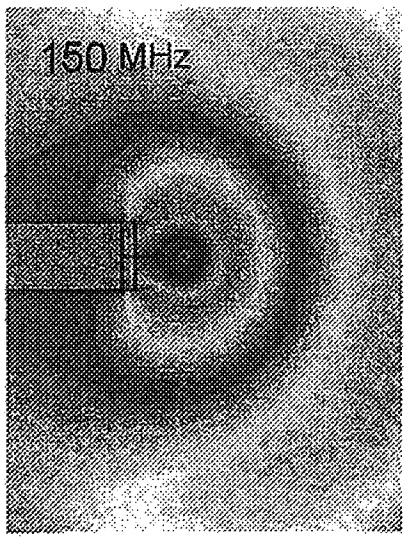

Since the reflection scattering from a backplane can interfere with radiation at some frequencies when covering a large bandwidth, backscatter from the conductive backplane 200 (e.g., a metallic backplane) may be minimized or reduced with an RF absorber 400 (shown in FIG. 1), such as commercially available ferrite tiles. The backplane 200 may also be coated with a meta-material with engineered permeability and permittivity to enhance antenna gain. While the RF absorber 400 or the meta-material are not necessary, in some cases, the RF absorber 400 or the meta-material may enhance stability over larger bandwidths. In some applications, the support structure for the antenna may have limited space. For example, a bulkhead on an airplane wing provides a reduced sized backplane capture area, compared to mounting the antenna on the relatively large fuselage. Therefore, when the antenna is mounted at an edge of the wing or in a pod, the losses intercepted by a lossy material are not significant. As shown in FIG. 3, most of the energy spills over and around the absorber coated bulkhead as shown in the field patterns at the ends of the bandwidth extremities, over a 5:1 bandwidth. FIG. 3 illustrates a side view of a Continuous Current Rod Antenna and the field patterns showing radiation with limited backplane interference at 150 MHz and 500 MHz.

Figure 4:
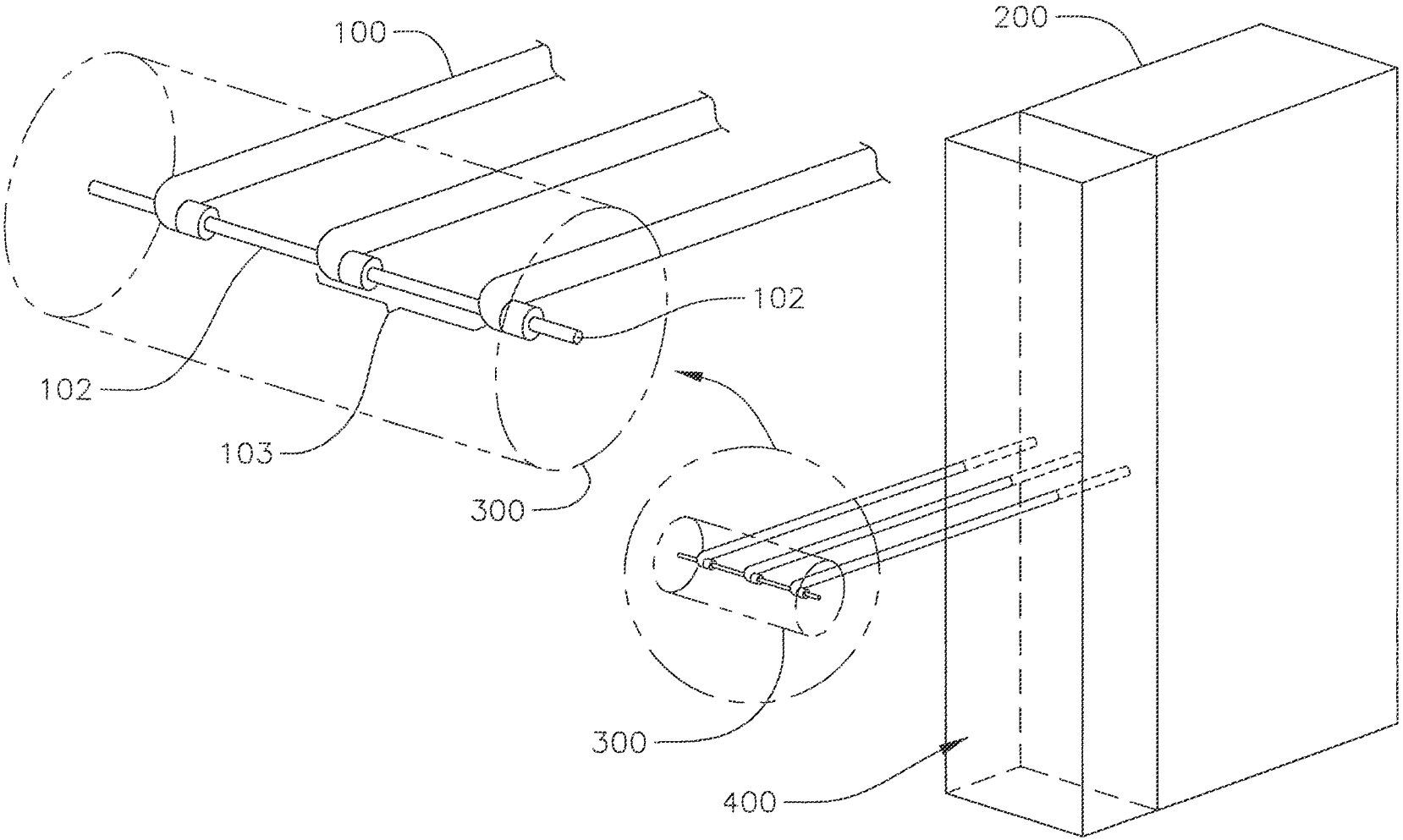
FIG. 4 is an enlarged perspective view of a portion of the Continuous Current Rod Antenna according to an embodiment of the present invention.

FIG. 4 is an enlarged perspective view of a portion of the Continuous Current Rod Antenna according to an embodiment of the present invention.

According to the embodiment shown in FIG. 4, the feed lines 100 are coaxial cables. The coaxial cables may be 50 Ohm terminated. At one end of the coaxial cables, the center conductors 102 are exposed and bent at right angle and electrically connected in turn to the outer conductor ground of the adjacent coaxial cable so as to create an array of high current conduits that are collinear along the length direction of the dielectric sleeve 300. The dielectric sleeve 300 may be a MgTi ceramic sleeve with a diameter equal to approximately 1/50th wavelength. By the virtue of adding many radiator filaments 100*a* together over at least about ½ wavelength, the connected radiator filaments 100*a* act as a continuous current filament. As such, a large and continuous current is induced along the collinear array of radiator filaments 100*a* that couple electromagnetic energy to free space.

One of the goals of an antenna design is to transform the impedance to minimize the reactance of the device so that it appears as a resistive load. An "antenna inherent reactance" includes not only the distributed reactance of the active antenna but also the natural reactance due to its location and surroundings. Reactance is unwanted and diverts energy into the reactive field. According to an embodiment of the present invention, the impedance of the energy field from the current line running axially the length of the array of radiator filaments 100*a* can be transformed to a real value and matched to free space with low reactance by the dielectric sleeve 300, with a diameter about 1/100 wavelength with a permittivity of Er=40 or greater. The dielectric sleeve 300 may have a round or square shape cross-section, may be fabricated in a monolithic rod or blocks, and is slipped over the radiator filaments 100*a*. The dielectric sleeve 300 may be fabricated out of typical low loss high dielectric material such as ceramic magnesium titanate. However, the present invention is not limited to the above described embodiments, and the dielectric sleeve 300 may have other suitable shapes and may be fabricated out of other suitable dielectric materials.

Figure 5:
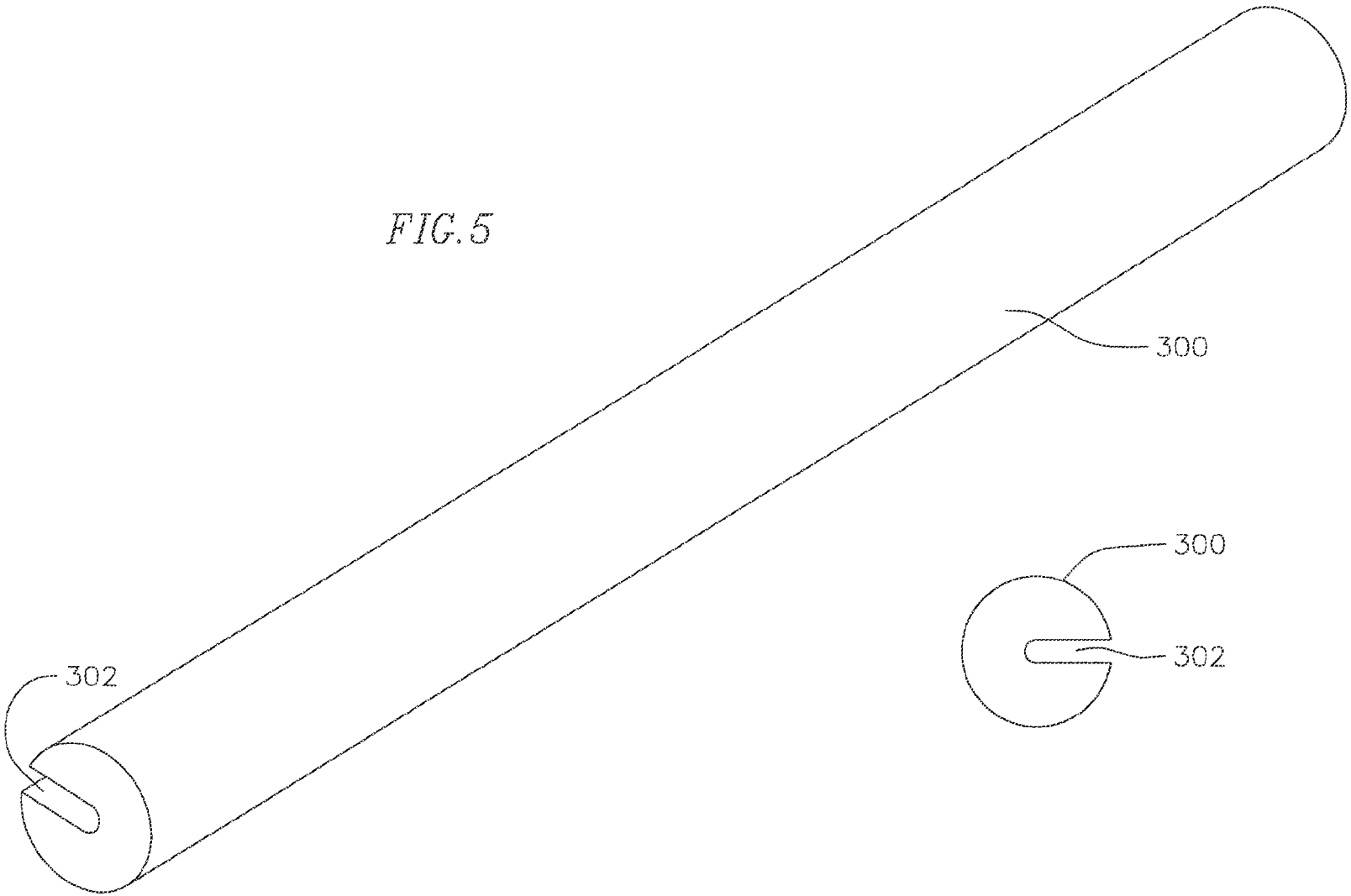
FIG. 5 illustrates a dielectric sleeve in a side view and a perspective view according to an embodiment of the present invention.

FIG. 5 illustrates a ceramic high dielectric sleeve in a perspective view and a side view according to an embodiment of the present invention.

Referring to FIG. 5, the dielectric sleeve 300 is formed by a solid rod having a substantially circular cross section with a diameter of equal to approximately 1/50th wavelength and a suitable length (e.g., half wavelength or more). A notch 302 is formed running across the length of the dielectric sleeve 300 for receiving the radiator filaments 100*a* therein. The notch 302 has a suitable wide such that the rod can be inserted over the top of the current filaments. The dielectric constant of the dielectric sleeve 300 is 70 and is made of Mgo-CaO—$TiO_2$. However, the dielectric sleeve 300 may be made with other suitable shapes, sizes, and dielectric constants.

Figure 6:
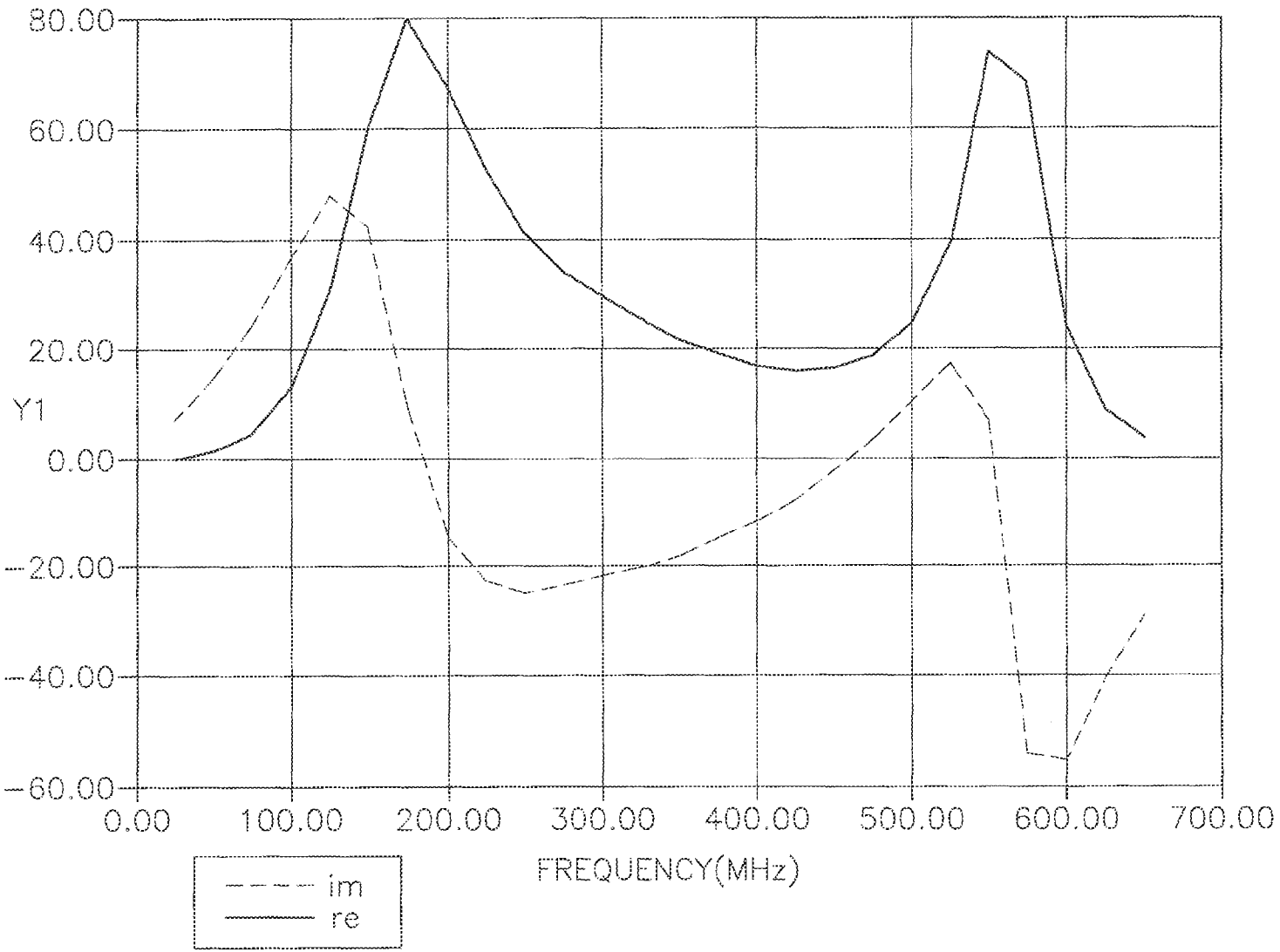
FIG. 6 is a graph showing the calculated real resistance and imaginary reactance over a bandwidth with the dielectric sleeve as shown in FIG. 5.
Figure 7A:
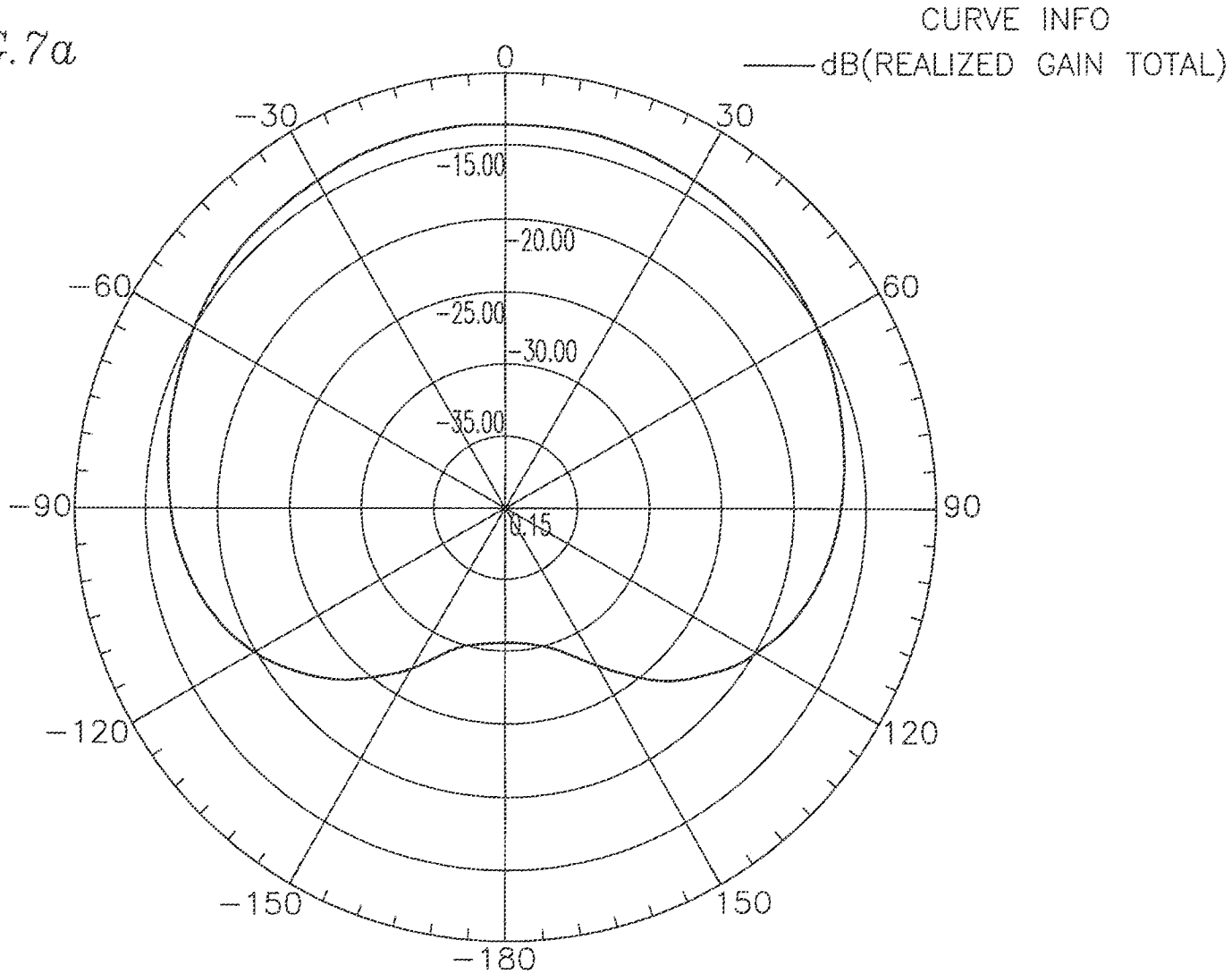
FIGS. 7*a*-7*f* illustrate calculated unit cell H-plane element patterns of the Continuous Current Rod Antenna according to an embodiment of the present invention.
Figure 7B:
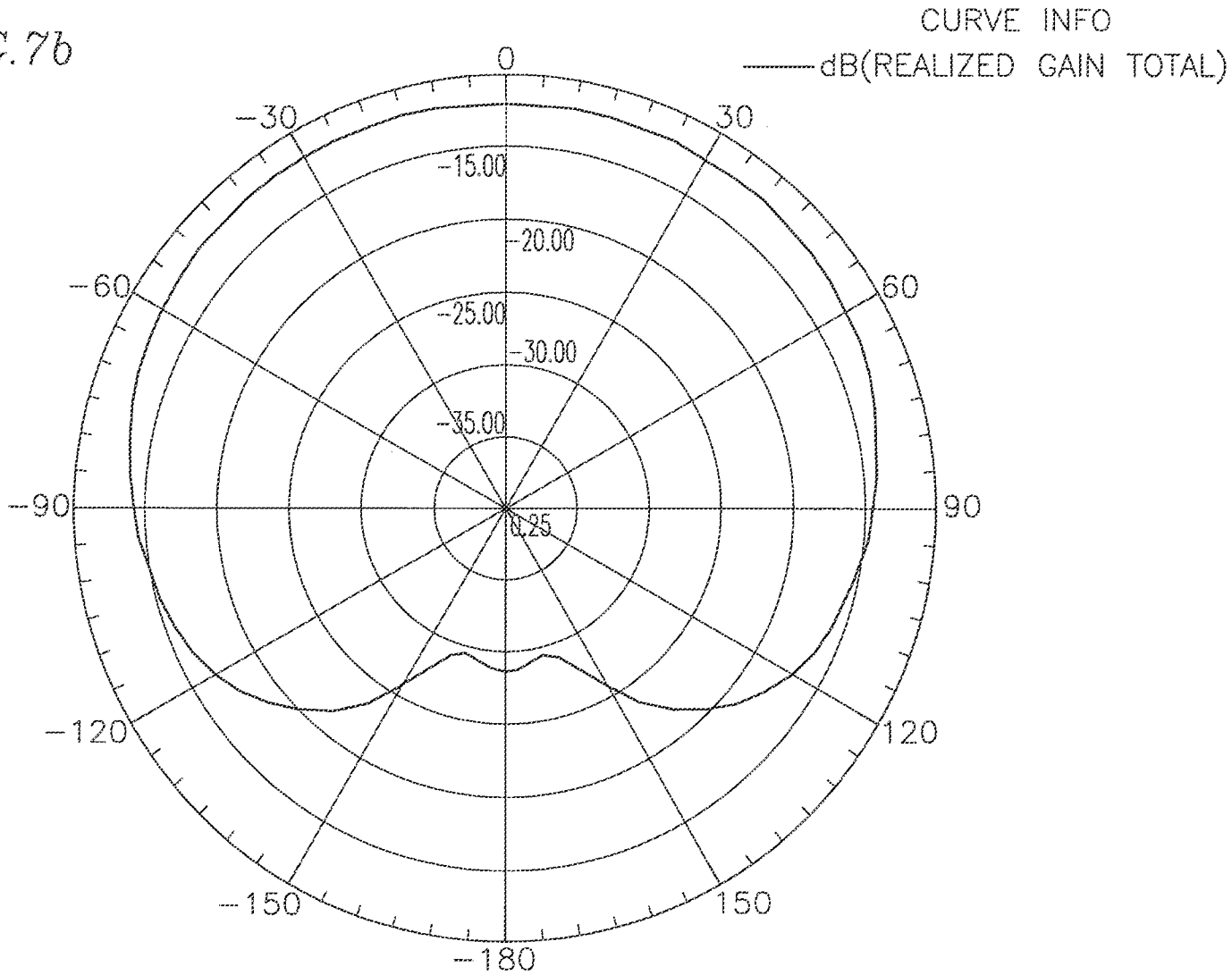
Figure 7C:
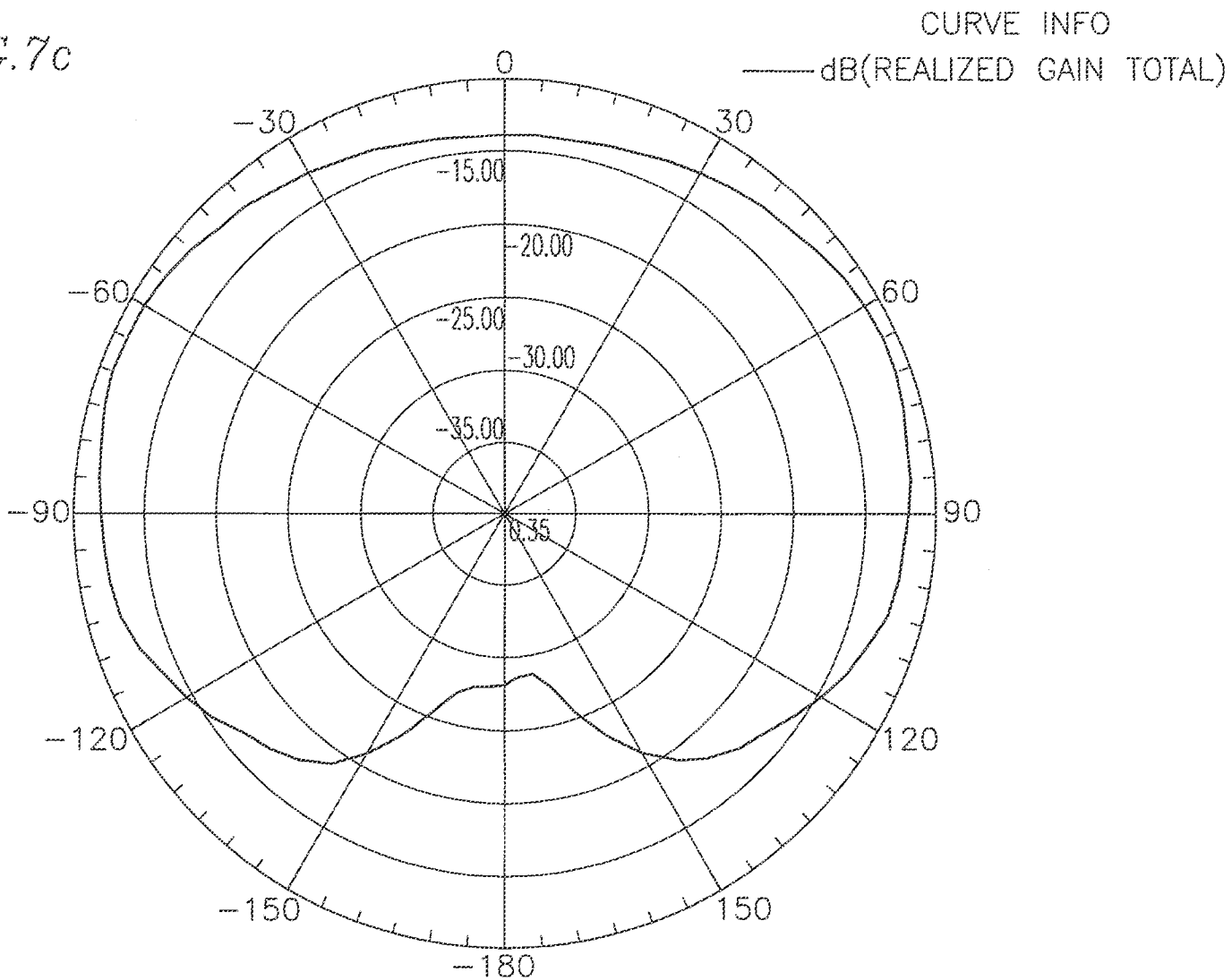
Figure 7D:
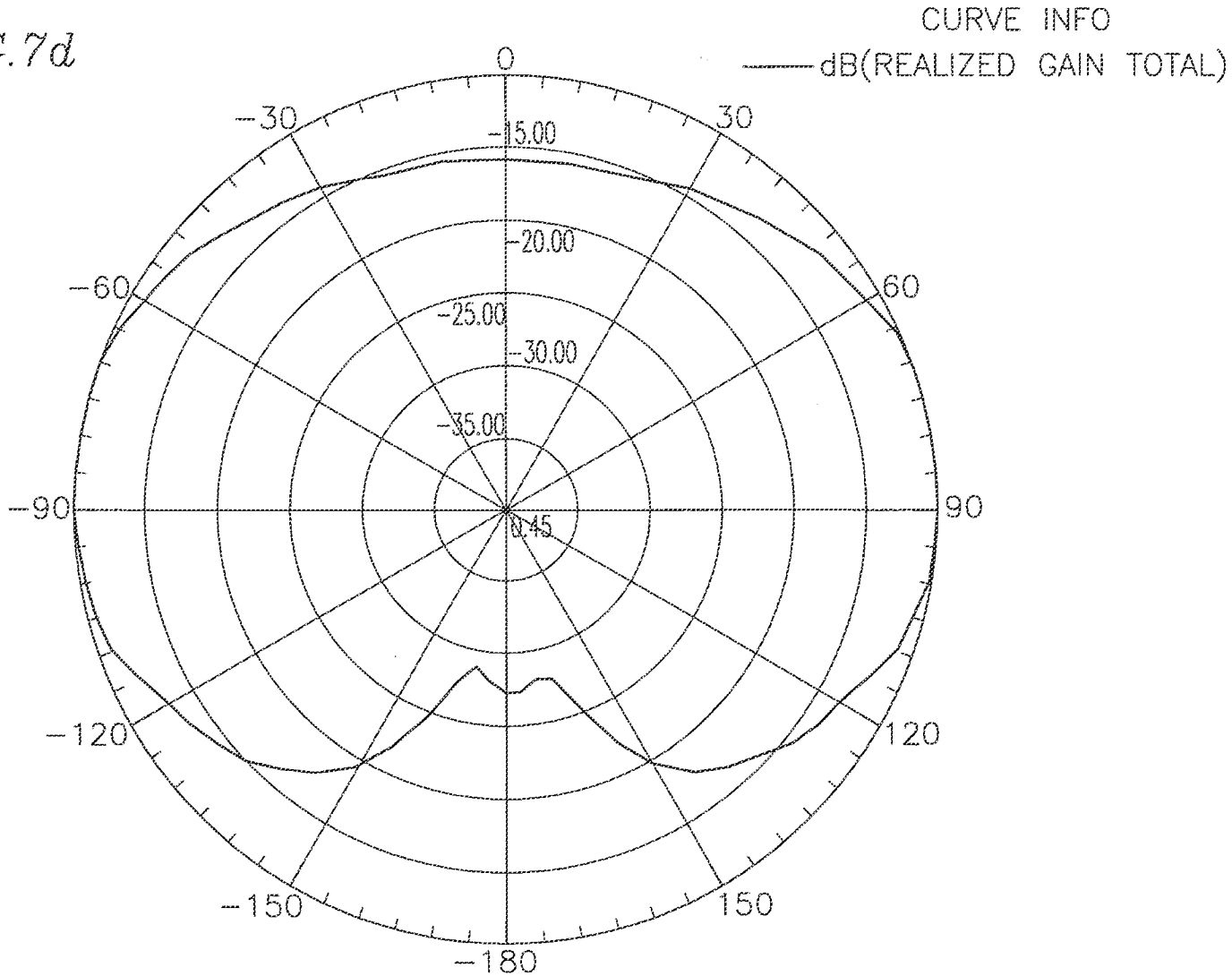
Figure 7E:
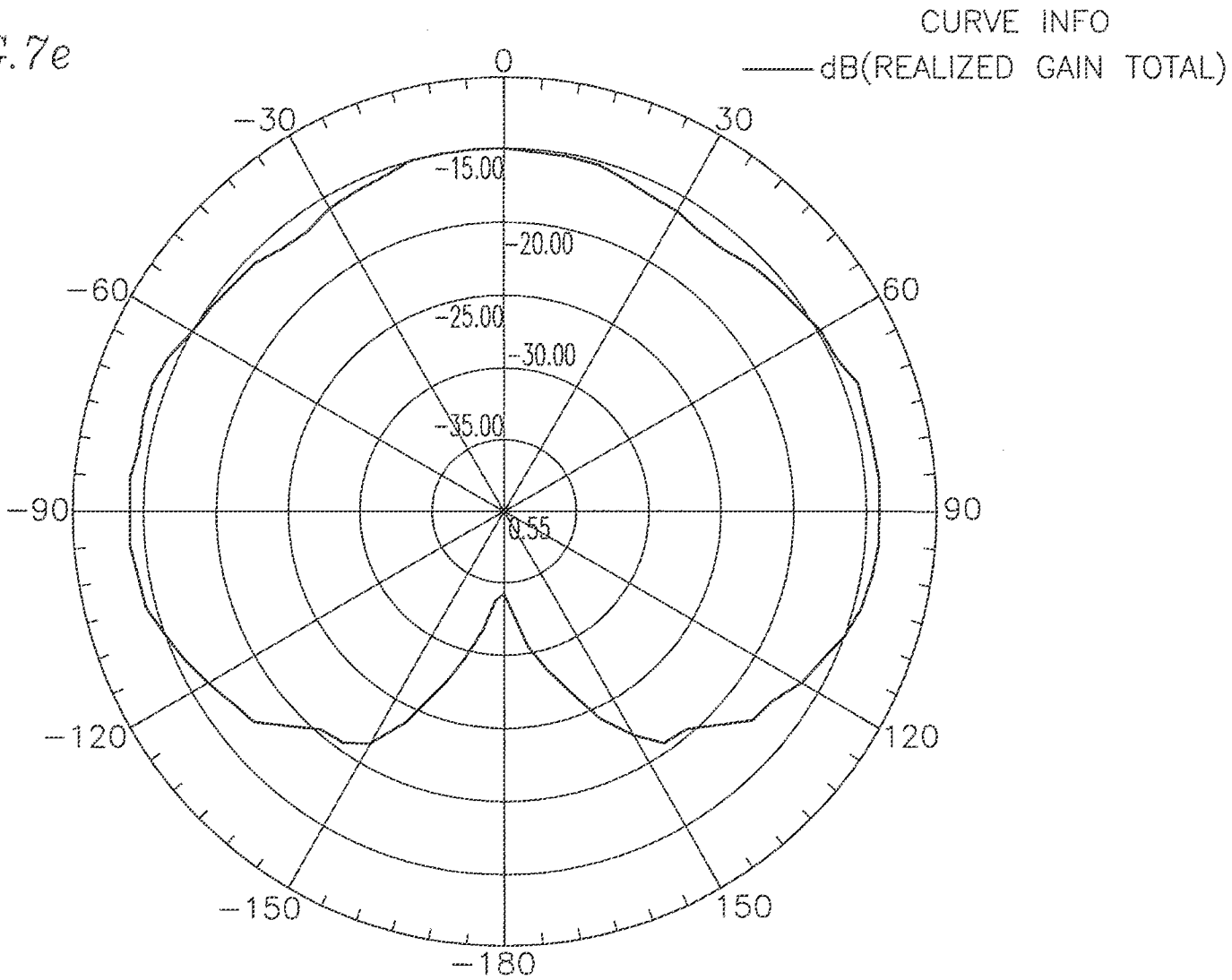
Figure 7F:
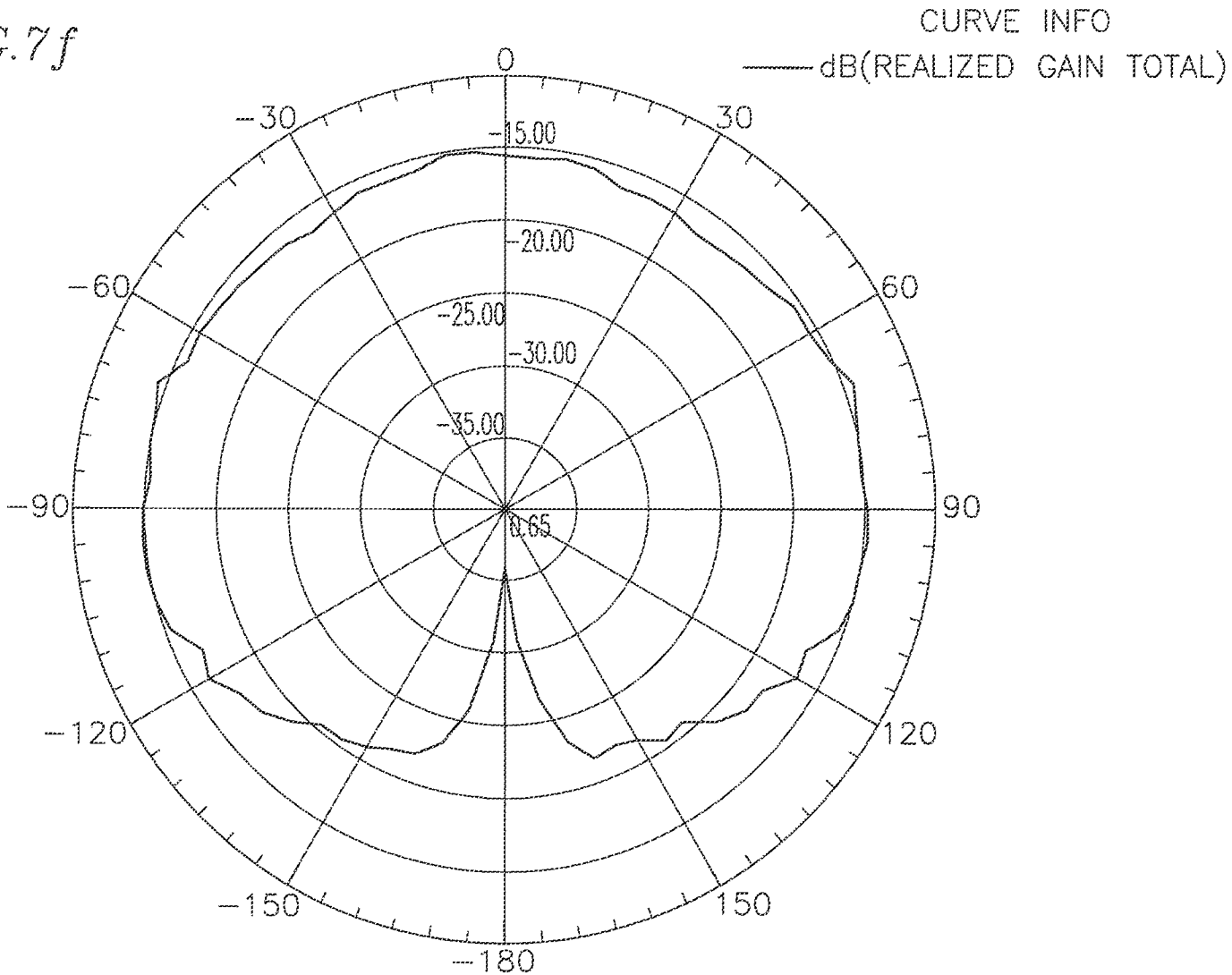
Figure 8A:
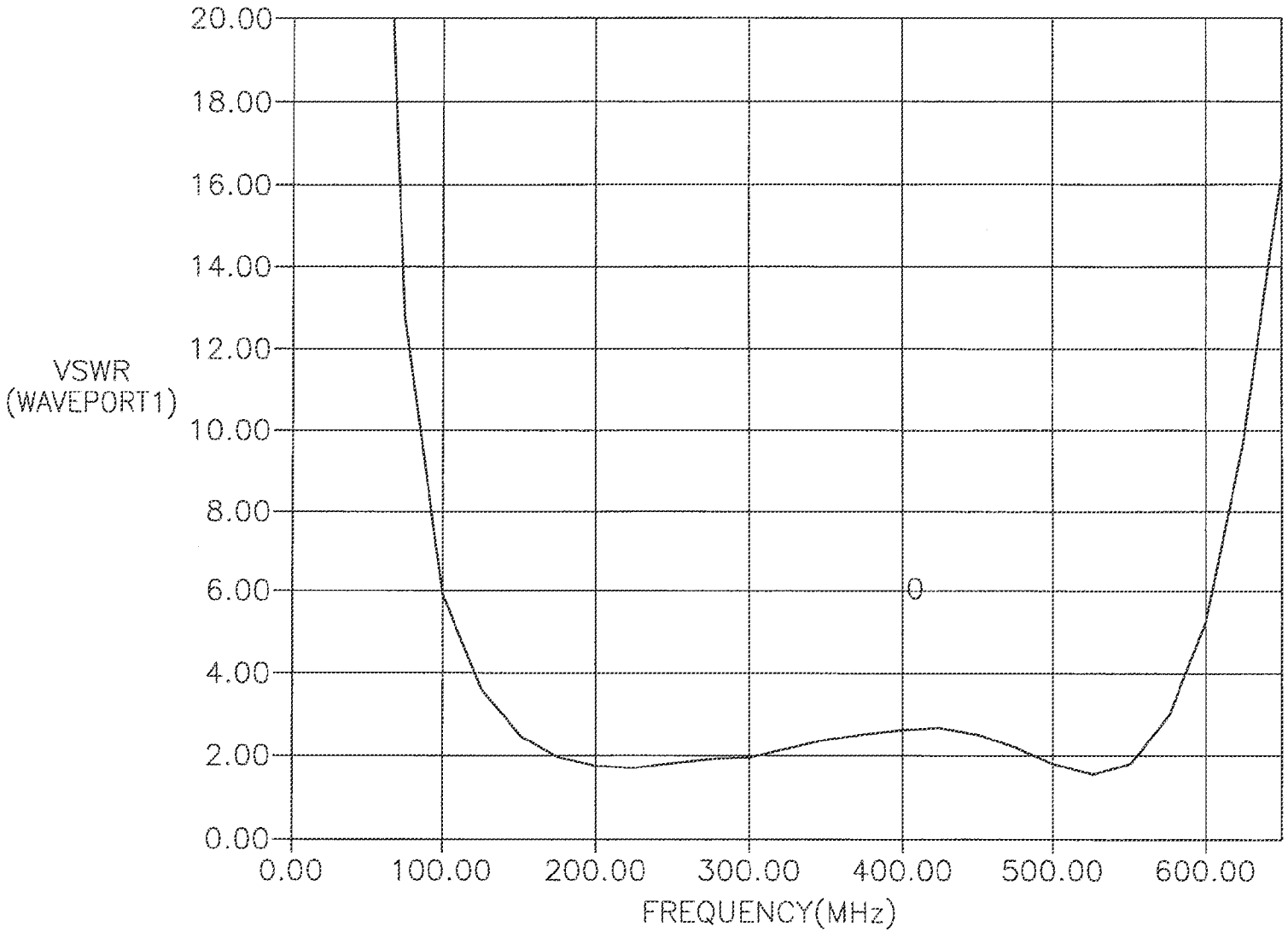
FIGS. 8*a*-8*d* illustrate active input VSWRs for broadside array in different E plan scans.
Figure 8B:
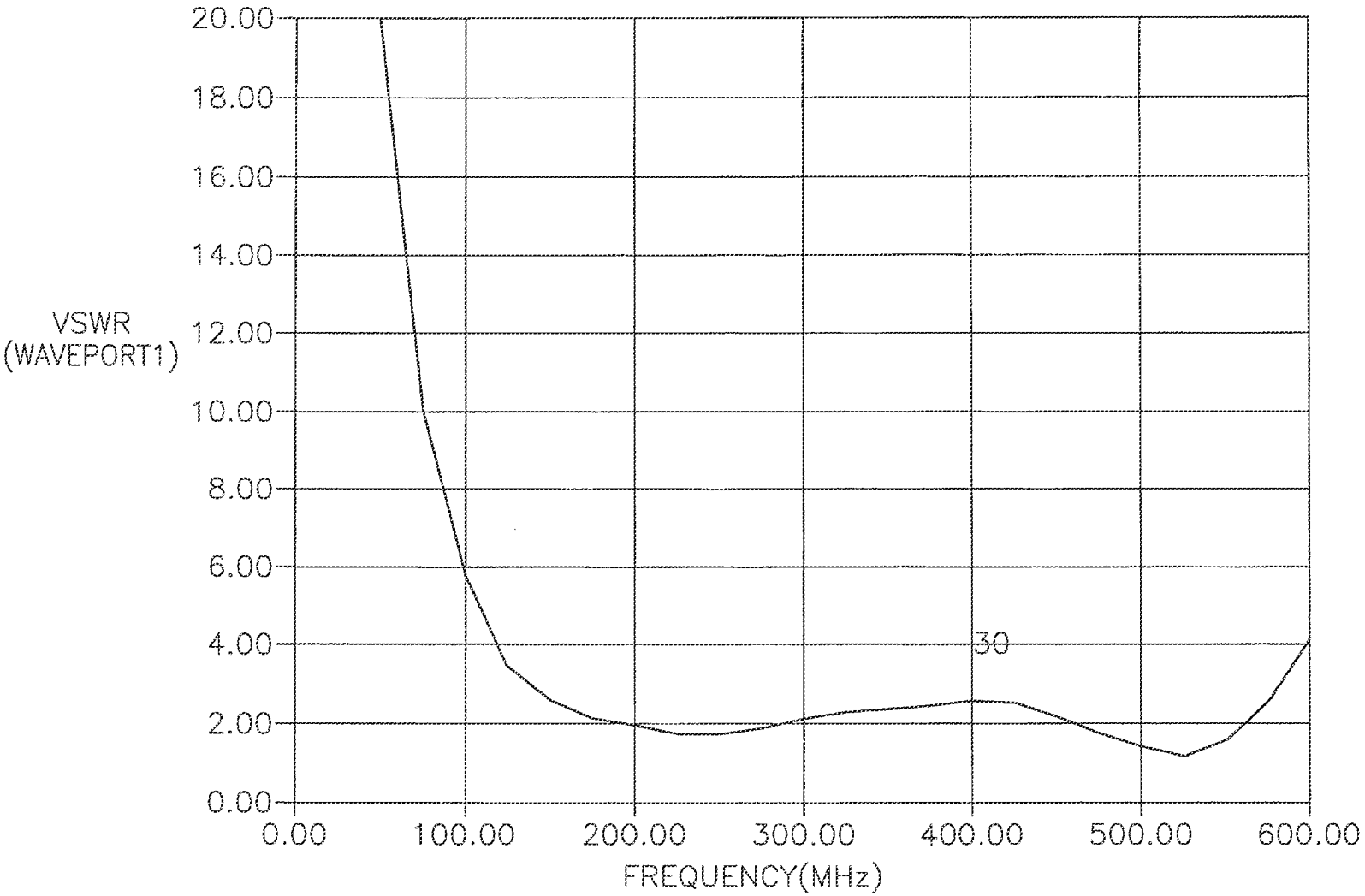
Figure 8C:
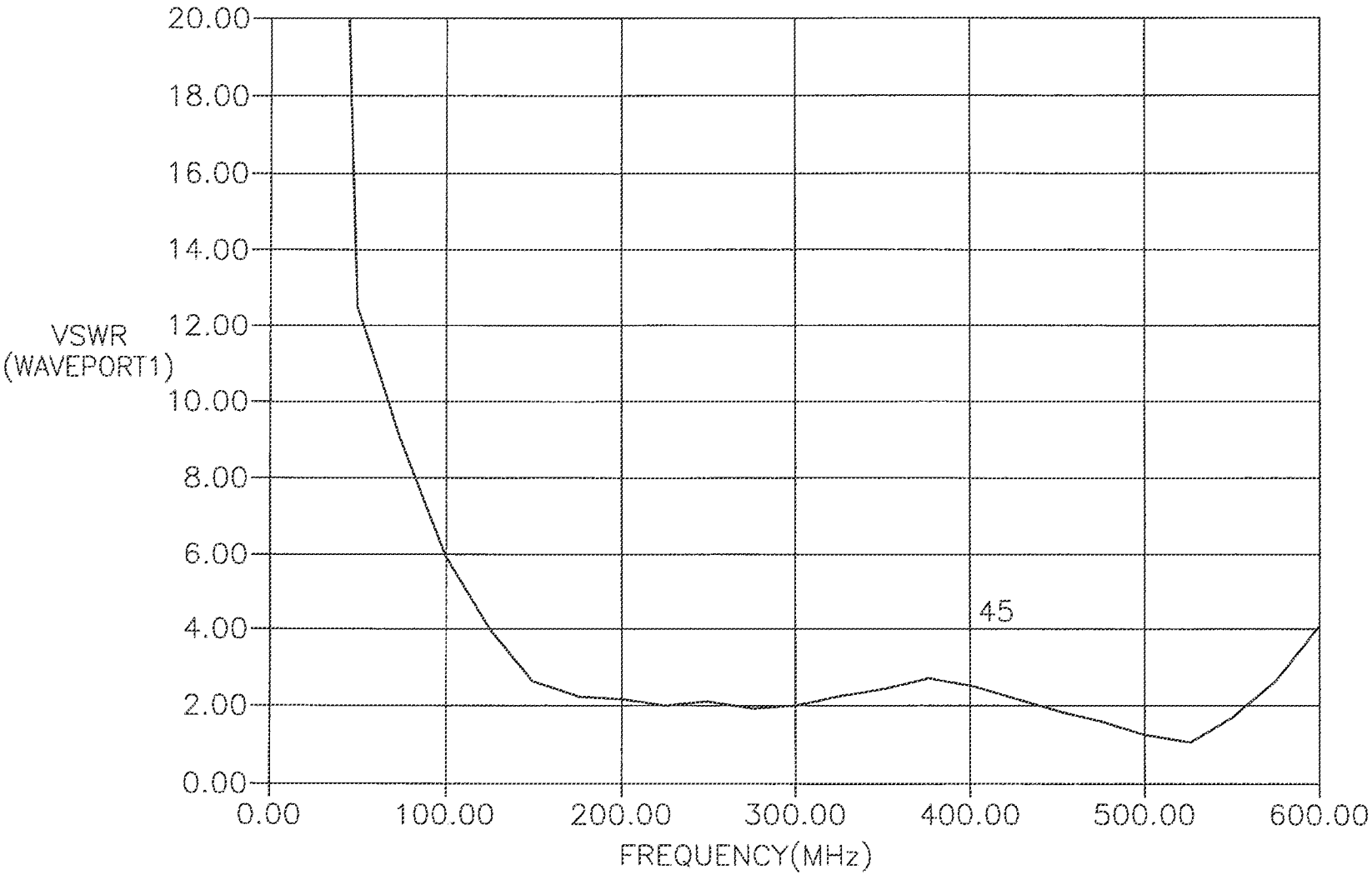
Figure 8D:
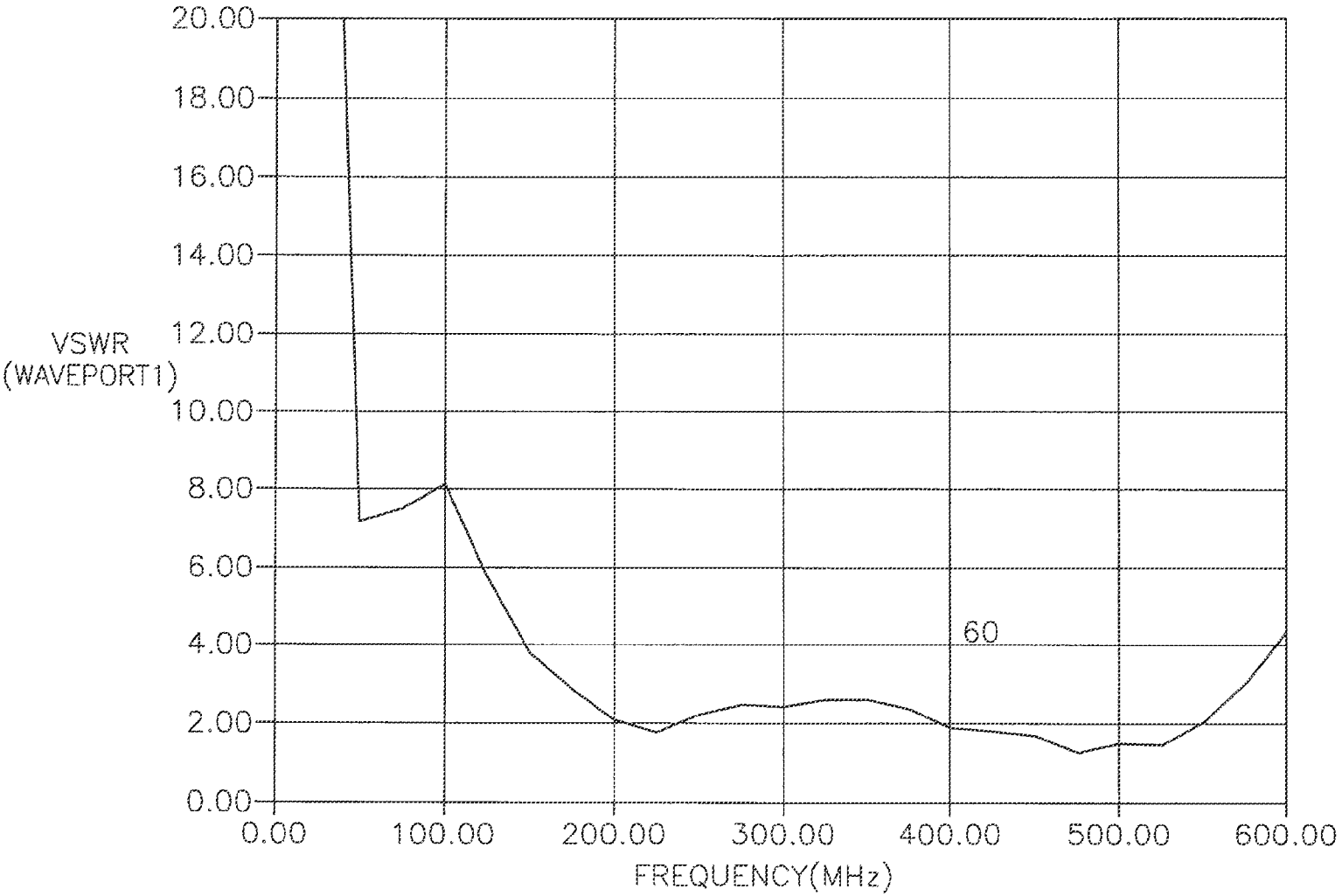

FIG. 6 is a graph showing the calculated real resistance and imaginary reactance over a large bandwidth with the ceramic high dielectric sleeve as shown in FIG. 5.

FIGS. 7*a*-7*f* illustrate calculated unit cell H-plane element patterns of a Continuous Current Rod Antenna according to an embodiment of the present invention.

FIGS. 8*a*-8*d* illustrate active input VSWRs for broadside array in different E plan scans (0, 30, 40, and 60 degrees).

As shown in FIGS. 7*a*-7*f*, the element patterns are calculated by HFSS analysis and appear to be stable for the above described Continuous Current Rod Antenna over a large bandwidth from 0.15 MHz to 0.65 MHz. The active impedance for an infinitely long Continuous Current Rod Antenna is also calculated by HFSS and is shown in FIGS. 8*a*-8*d* to be well matched demonstrating the feasibly of the design to form beams broadside to the Continuous Current Rod Antenna. The phase excitation in a phased array controls the beam pointing angle, and by controlling the phase and amplitude of excitation to each T/R element (e.g., T/R modules 500 in FIG. 2), the direction of the beam radiated by the array can be controlled. To produce a broadside beam, equal phase excitation is used. Other excitation schemes for producing other desired scan angles are within the knowledge of those skilled in the art, and therefore will not be discussed here. A Continuous Current Rod Antenna according to the above embodiments can radiate a beam efficiently in any scan direction in the plane of the transverse rod, up to 60 degrees perpendicular to the collinear array of radiator filaments. The Input VSWR is low over a 5:1 bandwidth for the E plane scan angles.

Comparative Examples

Some benefits of a Continuous Current Rod Antenna according to embodiments of the present invention will be demonstrated by the following comparative examples.

Figure 9A:
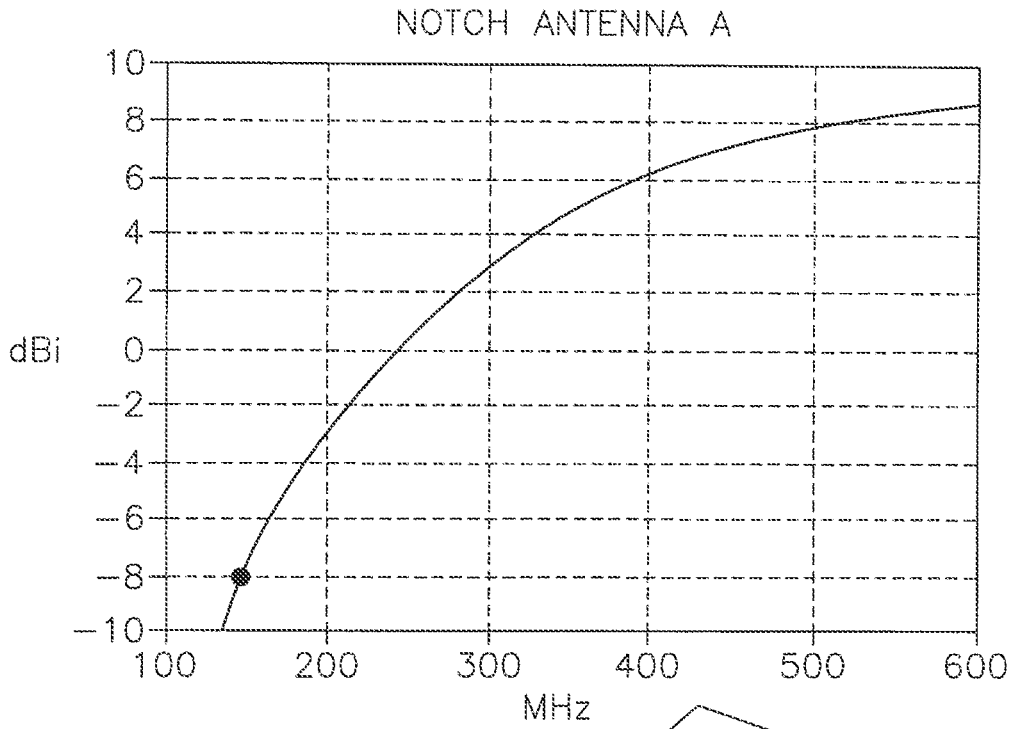
FIG. 9*a* illustrate a comparative notch antenna according to the related art.
Figure 9A:
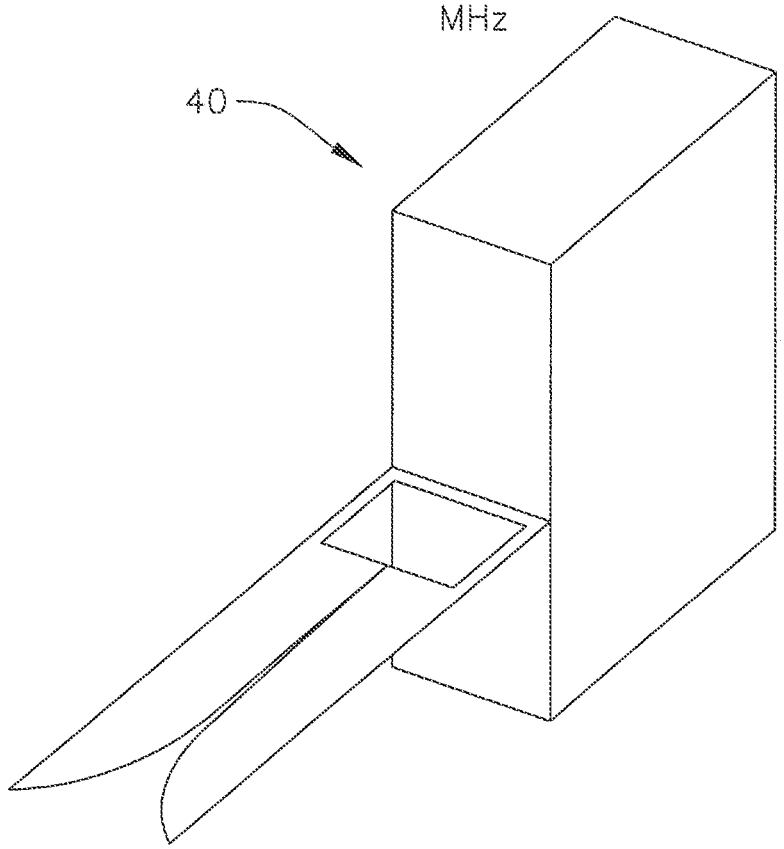
Figure 9B:
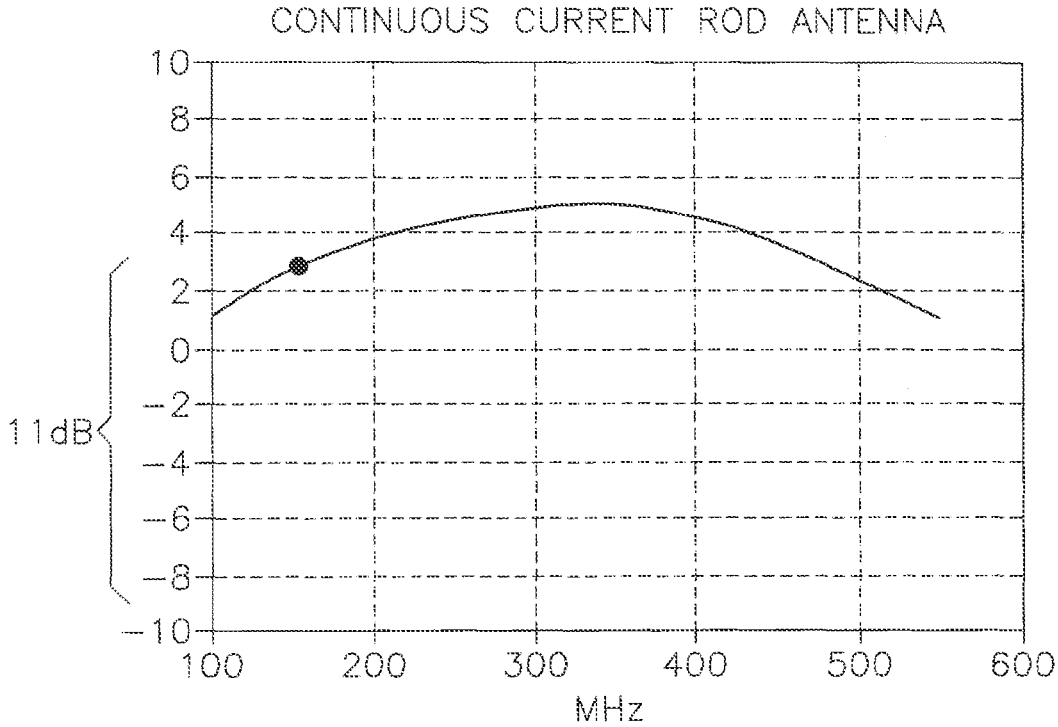
FIG. 9*b* illustrates a Continuous Current Rod Antenna according to an embodiment of the present invention and two comparative examples of notch antennas, and their corresponding graphs illustrating their realized gain.
Figure 9B:
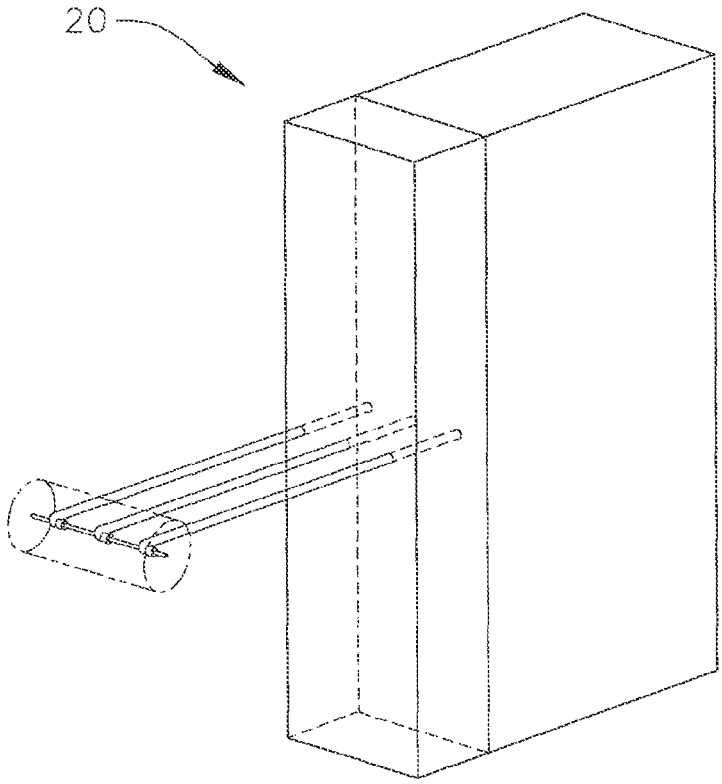

FIGS. 9*a* and 9*b* illustrate a Continuous Current Rod Antenna according to an embodiment of the present invention and a comparative notch antenna, and their corresponding graphs illustrating their realized gain comparison.

In FIG. 9*b*, a Continuous Current Rod Antenna 20 according to an embodiment of the present invention is scaled to about the same size as a comparative notch antenna A illustrated in FIG. 9*a*. The graphs in FIGS. 9*a* and 9*b* illustrate the realized gain per unit length of the antennas. In FIGS. 9*a* and 9*b*, one unit length is equal to ½ wavelength (e.g., 150 MHz) of the antenna. The notch antenna A (40) has a gain of −8 dBi at 150 MHz. However, the Continuous Current Rod Antenna 20 has a gain of about 3 dBi at 150 MHz that is at least about 11 dBi more gain compared to the notch antenna A.

Figure 10:
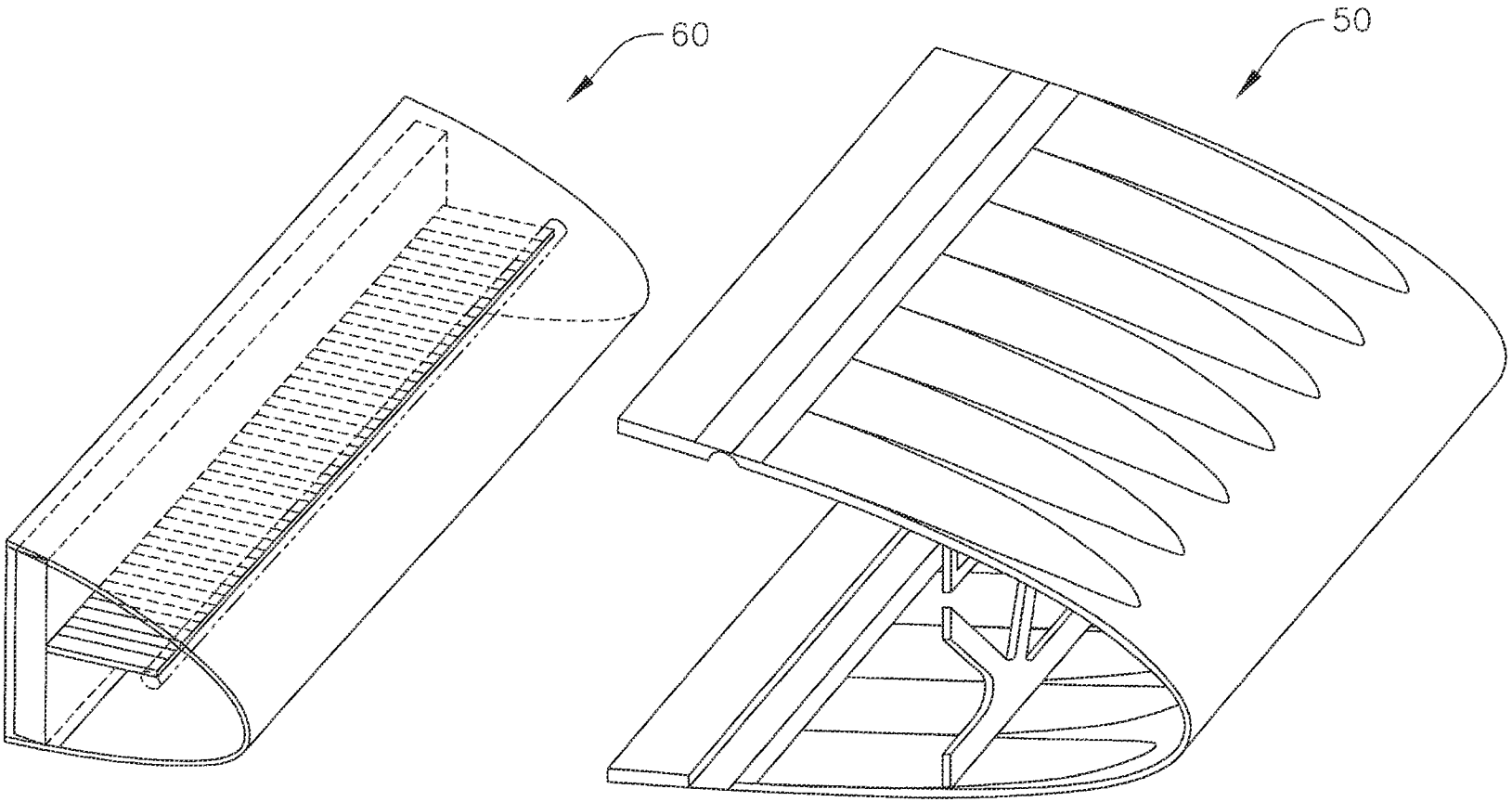
FIG. 10 illustrates a comparative flared notch antenna and a Continuous Current Rod Antenna according to an embodiment of the present invention.

FIG. 10 is a drawing illustrating a comparative flared notch antenna and a Continuous Current Rod Antenna according to an embodiment of the present invention.

As shown in FIG. 10, a flared notch antenna 50 with substantially the same bandwidth as a Continuous Current Rod Antenna 60 placed in an aerodynamic radome, is nearly twice the size of the Continuous Current Rod Antenna 60.

According to the above described embodiments of the present invention, a novel Continuous Current Rod Antenna may be fabricated by coupling an array of collinear antenna elements between an array of active RF T/R modules in close proximity to a conductive backplane that is optionally covered with an RF absorber, or meta material. Extremely tight lattices may be realized which stabilizes the radiation impedance and allows dense T/R packaging to aid in power generation. A current filament is excited by connecting parallel fed collinear currents and matched by the novel technique using a high dielectric sleeve. The Continuous Current Rod Antenna offers lower profile packaging, with higher gain over larger bandwidths than previously known by other collinear array techniques. It is also possible to connect as many transmitter modules as possible to an antenna array for combining power output optically which in turn lowers the output requirement for any one module, as to share the transmit power output between a large number of modules.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An antenna array comprising:

an array of feed lines extending in a first direction;

a dielectric sleeve extending in a second direction;

at least two radiator filaments configured to be fed in parallel with each other by respective feed lines of the array of feed lines, the radiator filaments collinearly arranged in the second direction within the dielectric sleeve; and a conductive backplane spaced from the radiator filaments by ⅛ wavelength or less of a center operating frequency of the antenna array, wherein each of the radiator filaments has a first end and a second end respectively connected to two adjacent feed lines of the array of feed lines.

2. The antenna array of claim 1, wherein a combined length of the radiator filaments in the second direction is at least about ½ wavelength of the center operating frequency of the antenna array.

3. The antenna array of claim 1, wherein a cross-section of the dielectric sleeve has a diameter about 1/100 wavelength of the center operating frequency of the antenna array, and has a permittivity (Er) of about 40 or greater.

4. The antenna array of claim 3, wherein the cross-section of the dielectric sleeve has a round shape or a square shape.

5. The antenna array of claim 1, wherein the dielectric sleeve comprises a low loss high dielectric material such as ceramic magnesium titanate.

6. The antenna array of claim 1, further comprising an RF absorber on the conductive backplane.

7. The antenna array of claim 6, wherein the RF absorber comprises a ferrite material having high real permeability and low imaginary permeability.

8. The antenna array of claim 1, wherein a center-to-center distance between adjacent ones of the radiator filaments is about 1/20 wavelength or less of the center operating frequency of the antenna array.

9. The antenna array of claim 1, wherein the array of feed lines is an array of transmission lines.

10. The antenna array of claim 9, further comprising a plurality of transmit/receive (T/R) modules respectively connected to the radiator filaments via the array of transmission lines.

11. The antenna array of claim 10, wherein the plurality of T/R modules are configured to drive the radiator filaments without the use of a balun.

12. The antenna array of claim 1, further comprising a plurality of transmit/receive (T/R) modules connected to the respective feed lines, the array of feed lines being configured to propagate energy from the respective T/R modules to the respective radiator filaments.

13. The antenna array of claim 12, wherein each of the respective feed lines is a coaxial cable, an end of the coaxial cable being bent at a substantially right angle, and the radiator filament is connected between the end of the bent coaxial cable and an outer grounded portion of an adjacent coaxial cable.

14. The antenna array of claim 10, wherein the T/R modules are housed in the conductive backplane.

15. The antenna array of claim 1, wherein the array of feed lines is an array of coaxial cables.

16. An antenna system comprising:

an array of feed lines extending in a first direction;

a dielectric sleeve extending in a second direction;

a plurality of radiator filaments configured to be fed in parallel with each other by respective feed lines of the array of feed lines, the radiator filaments collinearly arranged in the second direction within the dielectric sleeve;

a conductive backplane supporting the radiator filaments, and being spaced from the radiator filaments by ⅛ wavelength or less of a center operating frequency of the antenna array; and a plurality of transmit/receive (T/R) modules respectively electrically connected to the radiator filaments, wherein each of the radiator filaments has a first end and a second end respectively connected to two adjacent feed lines of the array of feed lines.

* * * * *